US005098588A

United States Patent [19]

Chang

[11] Patent Number: 5,098,588

[45] Date of Patent: Mar. 24, 1992

[54] NEW CLASS OF LUBRICANTS DERIVED FROM ARCHAEBACTERIAL LIPIDS

[75] Inventor: Eddie L. Chang, Silver Spring, Md.

[73] Assignee: The United States of America as represented by the Secretary of the Navy, Washington, D.C.

[21] Appl. No.: 442,961

[22] Filed: Nov. 29, 1989

[51] Int. Cl.[5] ..... C10M 129/20

[52] U.S. Cl. ..... 252/52 R; 252/49.8; 252/50; 436/71

[58] Field of Search ..... 252/49.8, 52 R, 50; 436/71

[56] References Cited

U.S. PATENT DOCUMENTS

| | | | |
|---|---|---|---|
| 4,257,771 | 3/1981 | Yee | 436/71 |
| 4,370,311 | 1/1983 | Ilekis | 436/71 |
| 4,766,015 | 8/1988 | Nikoloff et al. | 252/49.8 |
| 4,784,945 | 11/1988 | Artiss et al. | 436/71 |

OTHER PUBLICATIONS

Furhop et al., "Bolaamphiphiles and Monolayer Lipid Membranes Made From 1,6,19,24-Tetraoxa-3,21-Cyclohexatriacontadiene-2,5,20,23-Tetrone", J. Am. Chem. Soc., 108, 1785-1791 (1986).

Chappe et al., "Fossil Evidence for a Novel Series of Archaebacterial Lipids", Naturwissenschaften, 66, 522-523 (1979).

Bader et al., "Liposomes From A,W-Dipolar Amphiphiles With a Polymerizable Diyne Moiety in the Hydrophobic Chain", J. Poly. Sci., 20, 1623-1629 (1982).

*Primary Examiner*—Jacqueline Howard

*Attorney, Agent, or Firm*—Thomas E. McDonnell; Barry A. Edelberg

[57] ABSTRACT

A new class of lubricants based on the general features of archaebacterial lipids but not limited to lipids solely extracted from archaebacteria is described. These lubricant/additive molecules have the following features: bipolarity, ether bonds and branched biphytanyl chains. They can be double chained or single chained. This new class has the potential to be highly thermally and chemically stable due to the above mentioned features.

15 Claims, No Drawings

NEW CLASS OF LUBRICANTS DERIVED FROM ARCHAEBACTERIAL LIPIDS

BACKGROUND OF THE INVENTION

1. Field of the Invention

This invention relates to a new class of lubricants for use in boundary lubrication. The lubricants are derived from archaebacterial lipids and are characterized by ether bonds, biphytanyl chains and $\alpha$, $\omega$-bipolarity. They are chemically stable at high temperatures, lubricate, either with or without a carrier lubricant and provide a friction coefficient of less than 0.1.

2. Description of the Background Art

A boundary lubricant, in general, supplies a friction coefficient of less than 0.1. Boundary lubricant compositions consist of a specific boundary lubricant in a carrier lubricant. These boundary lubricant compositions have several problems and limitations.

First of all, the compositions require a carrier for the boundary lubricant. This is due, in part, because many boundary lubricants must be in solution in order to be effective. This introduces an unwanted but necessary carrier lubricant into the system/material to be lubricated. Secondly, the boundary lubricants themselves are subject to thermal degradation. As the temperature of the material to be lubricated increases (engine parts, for example), the lubricant breaks down, causing increased friction between component surfaces. Thirdly, chemical degradation of boundary lubricants is a problem because many are subject to degradative processes such as peroxidation. Fourthly, many of these boundary lubricants are corrosive and may destroy the component surfaces to be lubricated. Finally, specialized boundary lubricants that work well at high temperatures usually exist as solids at room temperature and have to be pre-heated. All of these limitations severely limit the operating range of boundary lubricants.

SUMMARY OF THE INVENTION

Accordingly, it is an object of this invention to provide a boundary lubrication composition in which the boundary lubricant has a friction coefficient of less than 0.1.

It is also an object of this invention to provide a boundary lubrication composition in which the lubricant does not require pre-heating.

It is also an object of this invention to provide a chemically stable boundary lubricant composition.

Finally, it is an object of this invention to provide a boundary lubricant which need not be in a carrier lubricant.

These and additional objects of the invention are accomplished by synthesizing or modifying lipids of the type found in the archaebacteria to create a lipid-lubricant. These lipid-lubricants are characterized by ether bonds, branched biphytanyl chains, and $\alpha,\omega$-bipolarity.

DETAILED DESCRIPTION OF THE INVENTION

Three unique characteristics of lipids extracted from the archaebacterial membranes make these lipids excellent boundary lubricants. These characteristics are ether bonds, branched biphytanyl chains, and $\alpha$, $\omega$-bipolarity. The ether bonds in the lipid-lubricants render the lipid-lubricants more chemically stable, while the bipolarity of the lipid-lubricants appears to serve as either an added anchor for the lipid-lubricant to attach to the surface to be lubricated or as a factor for better packing for the lipid-lubricants. The branched biphytanyl chains give the lipid-lubricant fluidity at low temperatures and, since they do not contain any unsaturated bonds, are less susceptible to peroxidation and other forms of chemical degredation.

The lipid-lubricants of the present invention can be represented by the general formulas:

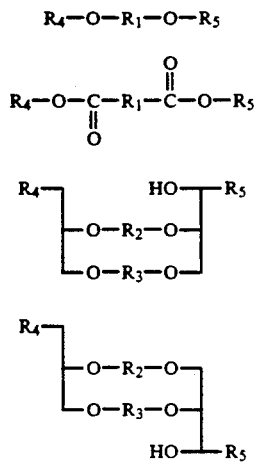

wherein $R_1$ is a linear or branched biphytanyl carbon chain having a chain length of between about 12 to about 32 carbons and containing any number of cyclizations and any number of halogenations along the carbon chain, $R_2$ and $R_3$ are branched biphytanyl carbon chains having a chain length of at least 32 carbons and containing any number of cyclizations and any number of halogenations along the chain, and $R_4$ and $R_5$ are hydrogen or any polar headgroup.

The carbon chain length of $R_2$ and $R_3$ should be at least 32 carbons, but beyond this, the length is not crucial to the invention. In fact, one would want to vary the carbon chain length to obtain lipid-lubricants that would operate within desired temperature ranges.

The cyclizations in $R_1$, $R_2$ and $R_3$ are preferably cyclopentane. Although one can vary the number of cyclizations along the carbon chain in order to obtain lipid-lubricants that operate within desired temperature ranges, it is preferable to have between about 0 to about 7 cyclopentane rings in $R_1$, $R_2$ and $R_3$.

Halogenations in $R_1$, $R_2$ and $R_3$ are for stabilization since halogenated compounds are known to be more stable than hydrogenated compounds. Fluorination would be the preferred halogenation.

Although the polar headgroups of $R_4$ and $R_5$ can be any common polar headgroup normally associated with lipids, it is preferable to select polar headgroups from the group comprising H, OH, choline, serine, ethanolamine, monosaccharides, disaccharides, trisaccharides, polysaccharides, inositol-$PO_4$-phosphoglycerol, phophatidylcholine, phosphatidylserine, phosphatidylethanolamine, phosphatidylglycerol, phophatidylinositol, $\beta$-D-galactopyranosyl-$\beta$-D-glucopyranose,

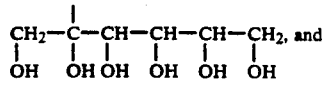

-continued

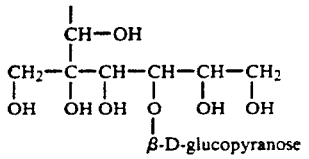

In the preferred embodiment of the invention, these modified lipid-lubricants are selected from the group of lipids derived from archaebacteria or synthesized, with the general structures:

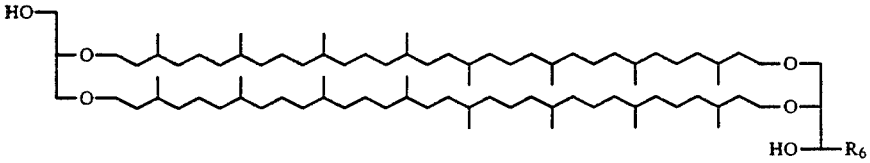

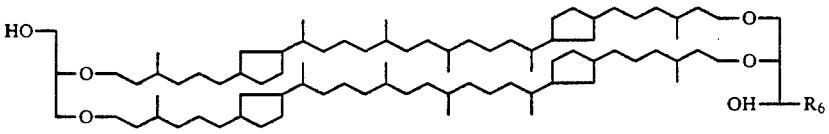

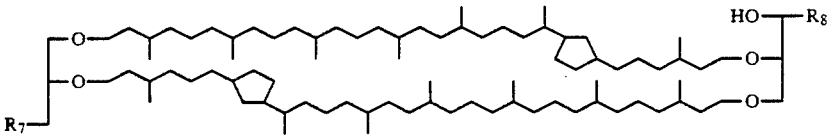

wherein $R_6$ is selected from the group comprising

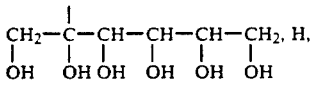

monosaccharides, disaccharides, trisaccharides, and polysaccharides, and $R_7$ and $R_8$ are selected from the group comprising inositol-$PO_4$-, phosphoglycerol, phophatidylcholine, phosphatidylserine, phosphatidylethanolamine, phosphatidylglycerol, phophatidylinositol, β-D-galactopyranosyl-β-D-glucopyranose, and

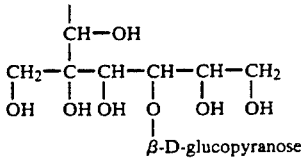

In the most preferred embodiment of the invention, the lipid-lubricants are selected from the group consisting of:

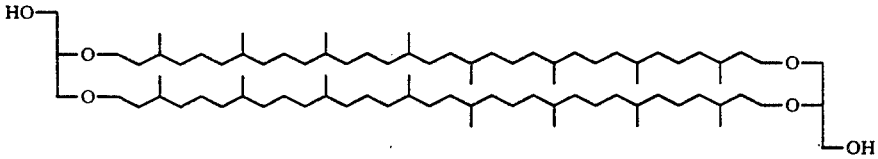

Acyclic Glycerol dialkyl glycerol tetraether

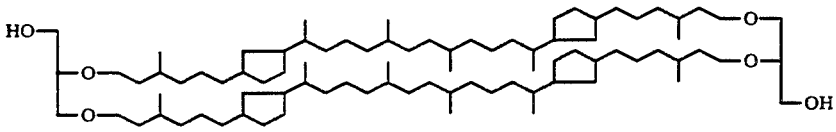

Cyclic Glycerol dialkyl glycerol tetraether

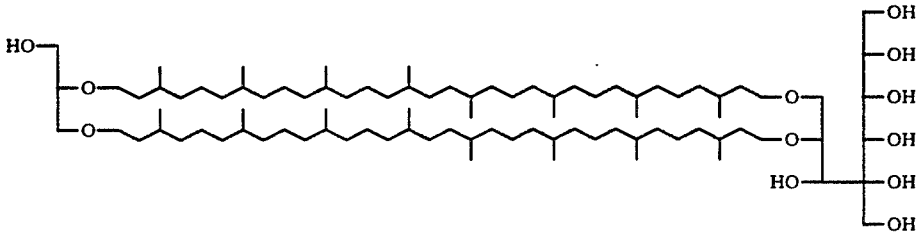

Acyclic Glycerol dialkyl nonitol tetraether

-continued

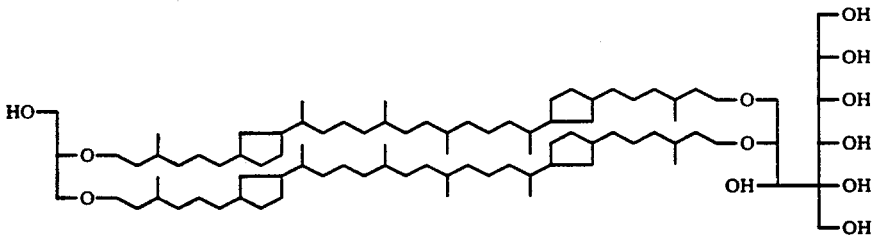

Cyclic Glycerol dialkyl nonitol tetraether

The preferred methods for obtaining these boundary lubricant lipids are by synthesizing them, extracting them from the archaebacterial membranes and then modifying the lipid-lubricants chemically or obtaining them from geological sources that contain skeletal forms of the archaebacterial lipids and then chemically modifying them as needed. Such geological sources include crude petroleum, shale oil and kerogen. In the most preferred embodiment, the lipids of the archaebacteria selected from the group comprising *Sulfolobus acidocaldarius, Thermoplasma acidophilum*, and *Methanospirillum hungatei* are extracted and then chemically modified, if necessary.

The boundary lubricants which are the subject of the present invention may be used for any application normally associated with boundary lubrication. Preferably, the lubricants are used for lubricating metal surfaces such as in engine lubrication, gear lubrication such as in missile gyros, and in lubricating computer disk surfaces.

Having described the invention, the following examples are given to illustrate specific applications of the invention. These specific examples are not intended to limit the scope of the invention described in this application.

EXAMPLE

Lyophilized cells of Sulfolobus acidocaldarius were extracted for 12 hours by Soxhlet extraction with 300 ml of chloroform-methanol (1:1) for each 1.5 g lyophilized cells. The residue from the initial extraction then underwent a second extraction with 140 ml of chloroform/methanol/5% trichloroacetic acid (1:2:0.8) at room temperature for 2 hours. After centrifugation, the pellet was washed twice with 32 ml of chloroform/methanol/water (1:2:0.8) The supernatants from the acid extraction and the two washes were pooled and chloroform and water added to obtain a ratio of chloroform-/methanol/water (8:4:3). The upper phase was extracted with an equal volume of chloroform (mixture 1) and the lower phase was washed with an equal volume of chloroform/methanol/water (3:48:47, mixture 2). The lower phase of mixture 2 was then washed with the upper phase of mixture 1. The lower phase from this mixture was then pooled with the lower phase of mixture 1. This constituted "extracted" lipids.

The "extracted" lipids were treated with 1 N methanolic HCl at 75° C. for 18 hours in a tightly capped flask, followed by adjusting the mixture to a chloroform/methanol/water mixture of 8:4:3. The lower phase was then dried, suspended in chloroform, and added to a silica gel column. The column was then sequentially eluted with chloroform, chloroform/ether (9:1), and chloroform/methanol (9:1). The chloroform/ether fraction (containing GDGT) was further purified on preparative TLC plates in chloroform/ether (9:1) and the GDGT extracted from the TLC plate with ether. The chloroform/methanol (9:1) fraction (containing GDNT) was further purified on TLC plates with chloroform/methanol (9:1) to obtain the GDNT.

A four-ball wear test system was set up. Each ball was composed of stainless steel. Six microliters of GDGT lipid in chloroform was placed in the system and the balls were spun at 100 RPM. Progressively heavier loads were placed on the system, starting at 5 kilograms and proceeding in increments of 5 kilograms up to 30 kilograms. The results show that the friction coefficient for the GDGT lipid remains below 0.1 for loads up to 25 kilograms. At 30 kilograms the friction coefficient rapidly increased to about 0.40.

Obviously, many modifications and variations of the present invention are possible in light of the above teachings. It is therefore to be understood that within the scope of the appended claims, the invention may be practiced otherwise than as specifically described.

What I claim is:

1. A method of lubricating a metal surface, comprising applying to said surface a boundary lipid-lubricant represented by the general formulas:

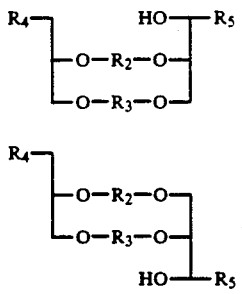

wherein $R_2$ and $R_3$ are branched biphytanyl carbon chains numbering at least 32 carbons, optionally containing cyclizations or halogenations along the chain, and $R_4$ and $R_5$ are selected from the group consisting of choline, serine, ethanolamine, monosaccharides, disaccharides, trisaccharides, polysaccharides, inositol-$PO_4$-phosphoglycerol, phosphatidylcholine, phosphatidylserine, phosphatidylethanolamine, phosphatidylglycerol, phosphatidylinositol, β-D-galactopyranosyl-β-D-glucopyranose,

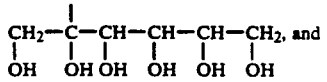

and

-continued

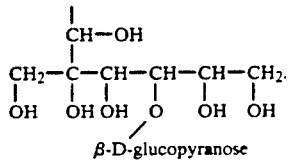

2. A method as described in claim 1 wherein the cyclizations in $R_1$, $R_2$ and $R_3$ are cyclopentanes.

3. The method of claim 1 wherein $R_2$ and $R_3$ have from zero to seven cyclopentane rings.

4. A method as described in claim 1 wherein the polar headgroups of $R_4$ and $R_5$ are selected from the group consisting of H, OH, choline, serine, ethanolamine, monosaccharides, disaccharides, trisaccharides, polysaccharides, inositol-$PO_4$-phosphoglycerol, phophatidylcholine, phosphatidylserine, phosphatidylethanolamine, phosphatidylglycerol, phophatidylinositol, β-D-galactopyranosyl-β-D-glucopyranose,

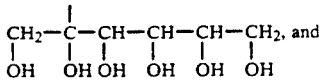

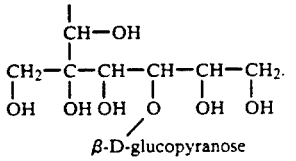

5. A method lipid as described in claim 1 wherein the lipid-lubricant is selected from the group consisting of lipids represented by the structures:

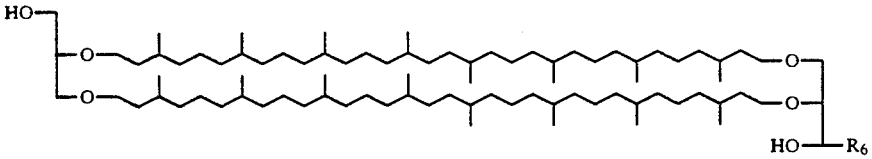

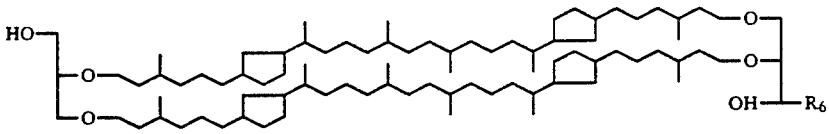

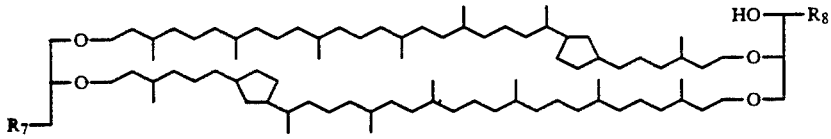

wherein $R_6$ is selected from the group comprising

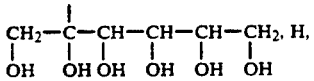

monosaccharides, disaccharides, trisaccharides and polysaccharides, and $R_7$ and $R_8$ are selected from the group comprising inositol-$PO_4$-, phosphoglycerol, phophatidylcholine, phosphatidylserine, phosphatidylethanolamine, phosphatidylglycerol, phophatidylinositol, β-D-galactopyranosyl-β-D-glucopyranose, and

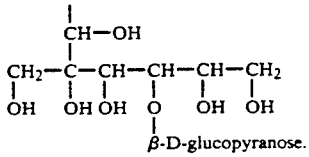

6. A method as described in claim 1 wherein the lipid-lubricant is selected from the group consisting of acyclic glycerol dialkyl nonitol tetraether, cyclic glycerol dialkyl nonitol tetraether, acyclic glycerol dialkyl glycerol tetraether, and cyclic glycerol dialkyl glycerol tetraether.

7. A method as described in claim 6 wherein the lipid-lubricant is acyclic glycerol dialkyl glycerol tetraether.

8. A method as described in claim 6 wherein the lipid-lubricant is acyclic glycerol dialkyl nonitol tetraether.

9. A method as described in claim 6 wherein the lipid-lubricant is cyclic glycerol dialkyl glycerol tetraether.

10. A method as described in claim 6 wherein the lipid-lubricant is cyclic glycerol dialkyl nonitol tetraether.

11. The method of claim 1, wherein $R_4$ and $R_5$ are selected from the group consisting of choline, serine, ethanolamine, phosphatidylcholine, phosphatidylserine, and phosphatidylethanolamine.

12. A method of lubricating a metal surface, comprising applying a boundary lipid-lubricant on a metal surface under load, said lubricant having one of the formulas:

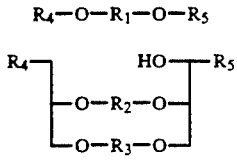

-continued

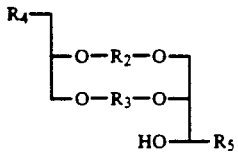

wherein $R_1$ is a linear or branched biphytanyl carbon chain having a chain length of between about 12 to about 32 carbons, optionally containing cyclizations or halogenations along the chain, $R_2$ and $R_3$ are branched biphytanyl carbon chains numbering at least 32 carbons, optionally containing cyclizations and halogenations along the chain, and $R_4$ and $R_5$ are selected from the group consisting of choline, serine, ethanolamine, monosaccharides, disaccharides, trisaccharides, polysaccharides, inositol-$PO_4$-phosphoglycerol, phosphatidylcholine, phosphatidylserine, phosphatidylethanolamine, phosphatidylglycerol, phosphatidylinositol, β-D-galactopyranosyl-β-D-glucopyranose,

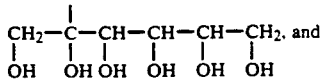

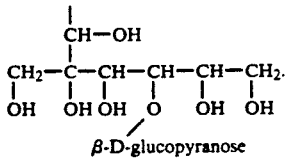

13. A method of lubricating a metal surface, comprising applying to said surface a boundary lipid-lubricant as described in claim 12 wherein $R_2$ and $R_3$ comprise from zero to seven cyclopentane rings.

14. A method as described in claim 12 wherein $R_1$, $R_2$, and $R_3$ are halogenated.

15. A method as described in claim 14 wherein the halogenations are fluorinations.

* * * * *